US012492874B2

(12) United States Patent
Vining

(10) Patent No.: US 12,492,874 B2
(45) Date of Patent: Dec. 9, 2025

(54) CHARGING HANDLE FOR A FIREARM

(71) Applicant: Ryan Vining, Patterson, LA (US)

(72) Inventor: Ryan Vining, Patterson, LA (US)

(73) Assignee: JA IP Holding, LLC, Morgan City, LA (US)

( * ) Notice: Subject to any disclaimer, the term of this patent is extended or adjusted under 35 U.S.C. 154(b) by 0 days.

(21) Appl. No.: 18/988,837

(22) Filed: Dec. 19, 2024

(65) Prior Publication Data

US 2025/0207877 A1 Jun. 26, 2025

Related U.S. Application Data

(60) Provisional application No. 63/612,636, filed on Dec. 20, 2023.

(51) Int. Cl.
*F41A 3/72* (2006.01)
*F41A 35/06* (2006.01)

(52) U.S. Cl.
CPC ..... *F41A 3/72* (2013.01); *F41A 35/06* (2013.01)

(58) Field of Classification Search
CPC ..... F41A 3/72; F41A 35/06
See application file for complete search history.

(56) References Cited

U.S. PATENT DOCUMENTS 7,240,600 B1 * 7/2007 Bordson ..... F41A 3/72 89/1.4
7,832,322 B1 * 11/2010 Hoel ..... F41A 3/20 89/1.4
7,861,635 B1 1/2011 Hoel
8,104,393 B2 1/2012 Kincel
8,336,436 B2 12/2012 Kincel
8,820,210 B2 9/2014 Melville
8,960,066 B2 * 2/2015 Gomez ..... F41A 3/72 89/1.4
9,488,424 B1 * 11/2016 Kincel ..... F41A 3/66
9,500,421 B1 * 11/2016 Geissele ..... F41A 3/72
9,846,003 B2 * 12/2017 Hwang ..... F41A 3/72
10,161,697 B1 * 12/2018 Underwood ..... F41A 3/72
11,187,476 B2 11/2021 Jung
2011/0174139 A1 * 7/2011 Olsen ..... F41A 3/72 89/1.4
2011/0214558 A1 * 9/2011 Kincel ..... F41A 9/00 89/1.4
2012/0291612 A1 * 11/2012 Kincel ..... F41A 35/06 89/1.4
2015/0053072 A1 * 2/2015 Bunker ..... F41A 3/72 89/1.4
2016/0298917 A1 * 10/2016 Hwang ..... F41A 35/06
2016/0356564 A1 * 12/2016 Curry ..... F41A 3/72
2017/0023321 A1 1/2017 Kincel
(Continued)

*Primary Examiner* — Joshua E Freeman
(74) *Attorney, Agent, or Firm* — Asgaard Patent Services, LLC; F. Wayne Thompson, Jr.

(57) ABSTRACT

The charging handle for a firearm includes a latch assembly and two levers, each operably and independently connected to the latch assembly. Additionally, each lever includes a biasing arm, the end portion of which is positioned in an overlapping arrangement with the end portion of the other biasing arm. In this way, the overlapping, or "nested," end portions of the biasing arms contact substantially the same portion of the cam surface on the latch. This allows each lever to provide an even resistance to the user when pulled.

5 Claims, 16 Drawing Sheets

(56) References Cited

U.S. PATENT DOCUMENTS

| | | | | |
|---|---|---|---|---|
| 2021/0080202 | A1* | 3/2021 | Jung | F41A 3/72 |
| 2021/0222972 | A1* | 7/2021 | Bray | F41A 35/06 |
| 2021/0381785 | A1* | 12/2021 | Underwood | F41A 3/72 |
| 2022/0316831 | A1* | 10/2022 | Torgersen | F41A 35/06 |
| 2023/0204310 | A1* | 6/2023 | Torgersen | F16J 15/02 89/1.4 |

* cited by examiner

CHARGING HANDLE FOR A FIREARM

CROSS-REFERENCE TO RELATED APPLICATION(S)

This application claims the benefit of U.S. Provisional Application Ser. No. 63/612,636, filed on Dec. 20, 2023, the entirety of which is incorporated herein by reference.

TECHNICAL FIELD

This disclosure relates to implementations of a charging handle for a firearm. More particularly, it concerns an improved charging handle for Stoner-type firearms, including AR-10 type, AR-15 type, and M4 type firearms, as well as their clones and derivatives.

BACKGROUND

The charging handle of a firearm, such as an AR15 type rifle, enables the user to manually manipulate the bolt carrier group. Its primary functions include chambering a round from the magazine, clearing the chamber, and resetting the hammer. Additionally, the charging handle can assist in resolving malfunctions by allowing manual cycling of the bolt carrier group.

Accordingly, there is a need for the charging handle disclosed herein. The present invention is directed to providing a charging handle configured to address these and other needs.

SUMMARY

It is to be understood that this summary is not an extensive overview of the disclosure. This summary is exemplary and not restrictive, and it is intended neither to identify key or critical elements of the disclosure nor delineate the scope thereof. The sole purpose of this summary is to explain and exemplify certain concepts of the disclosure as an introduction to the following complete and extensive detailed description.

Implementations of a charging handle for a firearm, such as an AR-15 type rifle, are disclosed. The charging handle includes a latch assembly and two levers, each operably and independently connected to the latch assembly. Additionally, each lever includes a biasing arm, the end portion of which is positioned in an overlapping arrangement with the end portion of the other biasing arm. In this way, the overlapping, or "nested," end portions of the biasing arms contact substantially the same portion of the cam surface on the latch. This allows each lever to provide an even resistance to the user when pulled.

An example charging handle comprises: a body, the body including a receiving area; a central shaft extending forwardly from the body, the central shaft being configured to engage a bolt carrier group of the firearm; a first lever pivotally coupled to the body, the first lever comprising a first biasing arm having an end portion with a radiused tip; a second lever pivotally coupled to the body, the second lever comprising a second biasing arm having an end portion with a radiused tip; and a latch pivotally coupled to the body, the latch having a relaxed position and a released position, and comprising a latch arm and a hook arm, with at least a portion of the latch arm disposed within the receiving area of the body. Pivoting the first lever moves the latch between the relaxed position and the released position. Similarly, pivoting the second lever also moves the latch between the relaxed position and the released position. The end portion of the first biasing arm and the end portion of the second biasing arm nest together, such that both radiused tips contact a camming surface on the latch arm of the latch.

Another example charging handle comprises: a body, the body including a receiving area and a clearance pocket located within the receiving area; a central shaft extending forwardly from the body, the central shaft being configured to engage a bolt carrier group of the firearm; a first lever pivotally coupled to the body, the first lever comprising a first biasing arm having an end portion with a radiused tip; a second lever pivotally coupled to the body, the second lever comprising a second biasing arm having an end portion with a radiused tip; and a latch pivotally coupled to the body, the latch having a relaxed position and a released position, and comprising a latch arm and a hook arm, with at least a portion of the latch arm disposed within the receiving area of the body. Pivoting the first lever moves the latch between the relaxed position and the released position. Similarly, pivoting the second lever also moves the latch between the relaxed position and the released position. The end portion of the first biasing arm and the end portion of the second biasing arm nest together within the clearance pocket, such that both radiused tips contact a camming surface on the latch arm.

BRIEF DESCRIPTION OF THE DRAWINGS

Like reference numerals refer to corresponding parts throughout the several views of the drawings.

DETAILED DESCRIPTION

FIGS. 1-6 and 7-11 illustrate an example charging handle 100 according to the principles of the present disclosure. The charging handle 100 is configured for use with an AR-15 type firearm. However, with minor modifications, some of its features could be adapted for use with other firearms.

Figure 3:
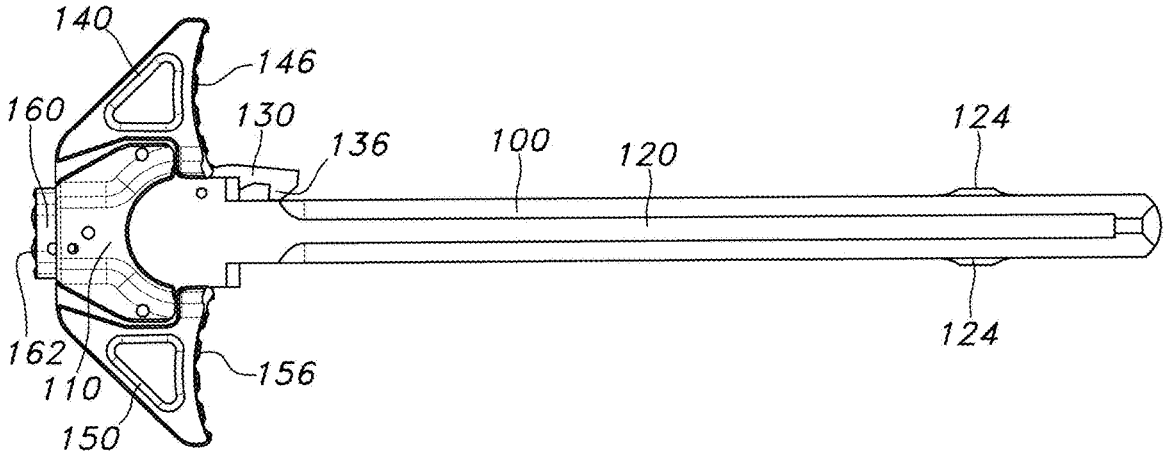
FIG. 3 is a top plan view of the charging handle shown in FIG. 1.
Figure 4:
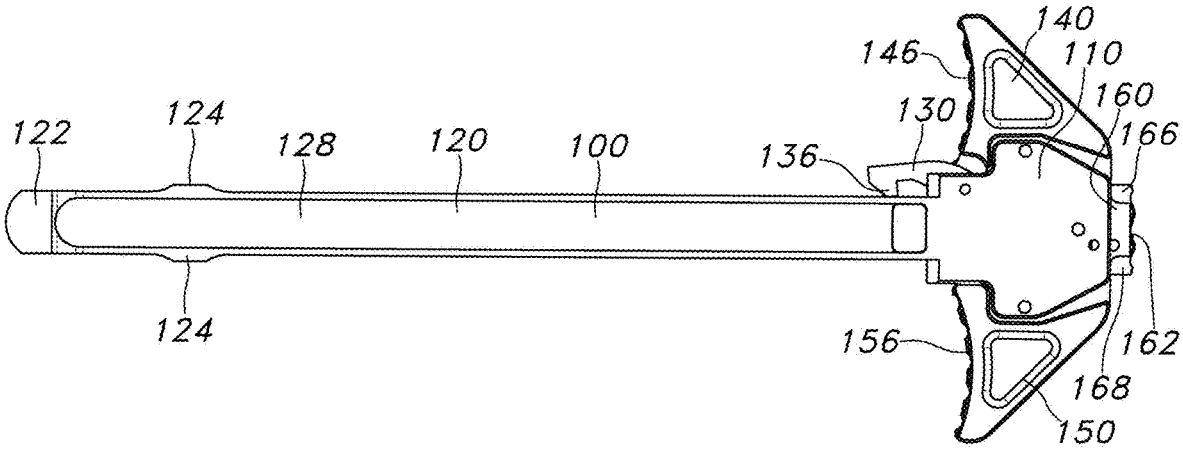
FIG. 4 is a bottom plan view of the charging handle shown in FIG. 1.
Figure 5:
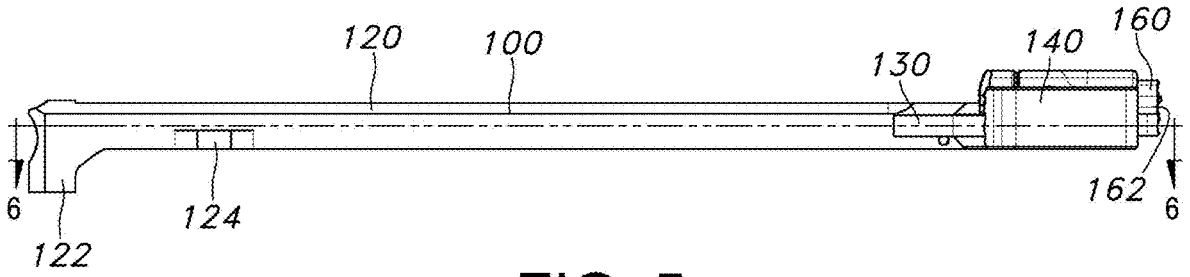
FIG. 5 is a side elevational view of the charging handle shown in FIG. 1.

The charging handle 100 comprises a body 110, a central shaft 120, and a latch assembly that includes a latch 130, a first lever 140, a second lever 150, and a plunger 160. The body 110 is disposed behind the central shaft 120, which extends forward from the body 110. The two levers (140, 150) and the latch 130 are pivotally coupled to the body 110; the plunger 160 is slidably disposed within a recess 114 in the back end of the body 110. When in a resting position, where the plunger 160 is not depressed, the plunger 160 is configured to prevent rotation of the levers 140, 150 (see, e.g., FIG. 6). When the plunger 160 is in a depressed position, the latch assembly is configured to allow either or both levers (140, 150) to be pulled, transitioning the latch 130 from a relaxed position (as shown in FIG. 3), where the latch 130 can engage the receiver of a firearm, to a released position (see, e.g., FIG. 10), which permits the normal operation of the charging handle 100.

Figure 12:
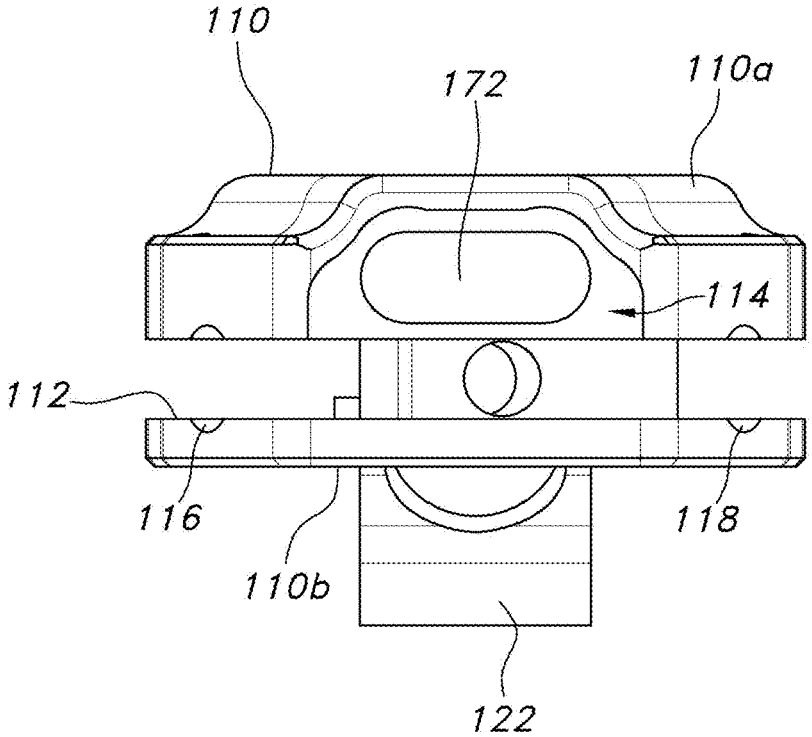
FIG. 12 is a rear elevational view of the charging handle body.
Figure 13:
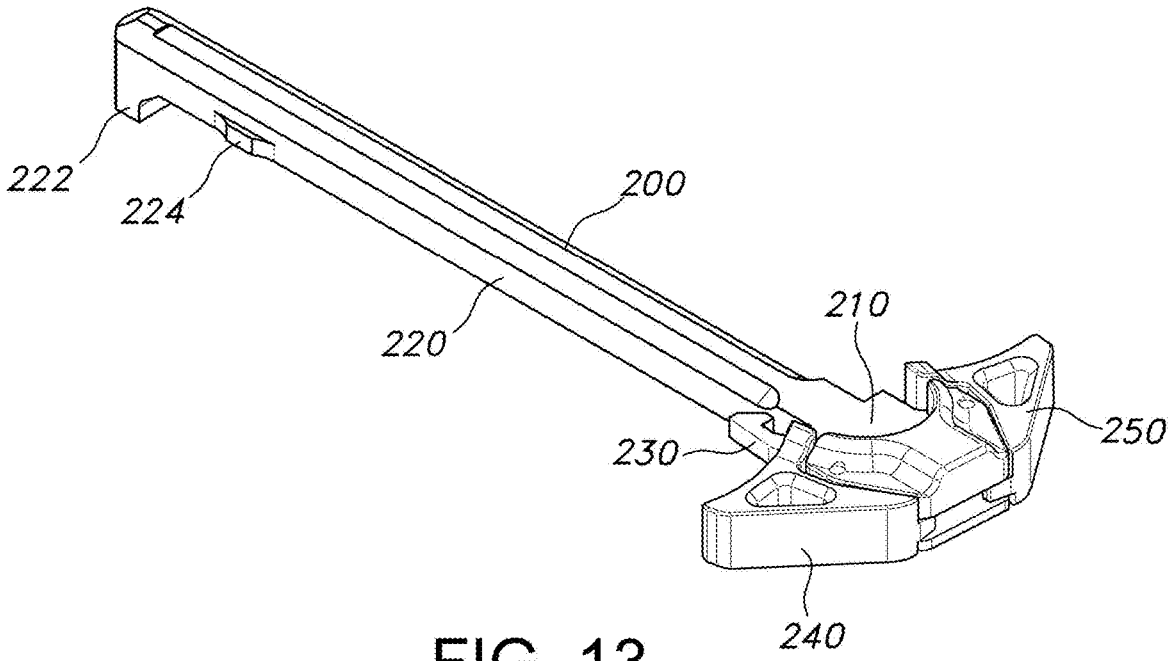
FIG. 13 is a perspective view of another charging handle according to the principles of the present disclosure.
Figure 14:
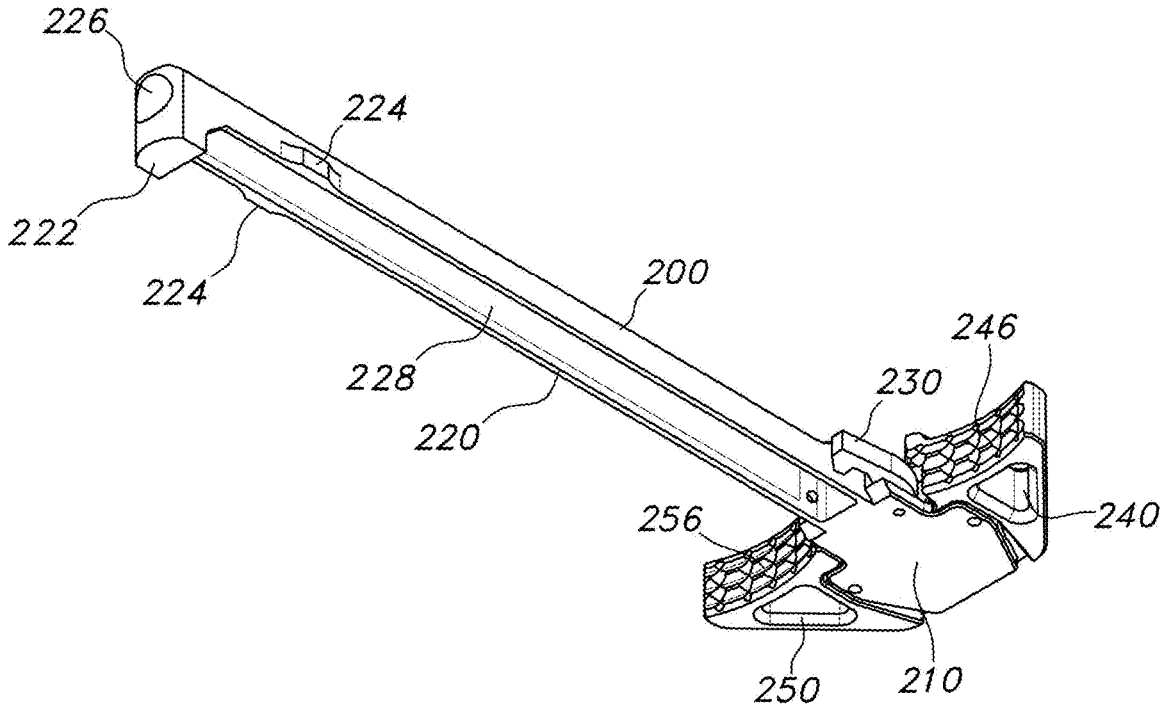
FIG. 14 is another perspective view of the charging handle shown in FIG. 13.

The body 110 of the charging handle 100 includes a receiving area 112, the recess 114 for the plunger 160, and a plurality of apertures for fasteners (e.g., roll pins) used to connect the latch 130, levers (140, 150), and plunger 160 to the body 110. The body 110 has an upper portion 110*a* and a lower portion 110*b*, which is spaced apart from and located below the upper portion 110*a* (see, e.g., FIG. 12). The upper portion 110*a* and the lower portion 110*b* define therebetween the receiving area 112, the purpose of which will be described in greater detail below. The recess 114 for the plunger 160 is disposed in the upper portion 110*a* of the body 110.

The central shaft 120 of the charging handle 100 includes a bolt carrier group engaging portion 122, a pair of alignment tabs 124, an aperture 126, and a longitudinal groove 128.

The bolt carrier group engaging portion 122 of the central shaft 120 is disposed toward a front end of the charging handle 100. The bolt carrier group engaging portion 122 engages the bolt carrier group of a firearm, such as an AR-15 type rifle, by interfacing with the charging handle engaging portion on the bolt carrier. The charging handle engaging portion is a projection on the bolt carrier; the bolt carrier being configured to carry a bolt of the bolt carrier group.

The pair of alignment tabs 124 are disposed on opposite sides of the central shaft 120 and assist in aligning the central shaft 120 in a particular direction within a slot in the upper receiver of a firearm, such as an AR-15 type rifle. Each alignment tab 124 is a projection extending from a side surface of the central shaft 120 that fits within a corresponding longitudinal recess in the upper receiver for slidable forward and backward movement of the charging handle 100 relative to the upper receiver.

The aperture 126 of the central shaft 120 is disposed within the bolt carrier group engaging portion 122 and is configured to receive the gas key of the bolt carrier therethrough. The aperture 126 provides clearance for the gas key, ensuring the charging handle 100 can properly engage with the bolt carrier.

The longitudinal groove 128 of the central shaft 120 extends from the aperture 126 to the body 110 of the charging handle 100, and is an otherwise well-known feature of charging handles configured for use with an AR-15 type firearm.

The latch 130 is pivotally coupled to the body 110 of charging handle 100 by a pin, or other suitable fastener. The latch 130 includes a latch arm 132, a hook arm 134, and a hook 136. The latch arm 132 is an elongate shaft that has a cam surface 138 on one side. The hook arm 134 includes an aperture 135 configured to receive the pin about which the latch 130 pivots. The hook 136 projects laterally from the hook arm 134 and is configured to engage a latch depression on the side of the upper receiver of an AR-15 type firearm. When the hook 136 engages the latch depression, the charging handle 100 is prevented from moving rearward and is effectively locked in position relative to the upper receiver. The latch arm 132 is disposed within the receiving area 112 of the body 110 of the charging handle 100, and is held there by the pin extending through the aperture 135 in the hook arm 134 of the latch 130.

The first lever 140 and the second lever 150 of the charging handle 100 are pivotally coupled to opposite sides of the body 110. Each lever (140, 150) has an aperture (142, 152) configured to receive a pin about which the lever (140, 150) pivots; the pin passes through apertures in the body 110 and the aperture (142, 152) in the lever (140, 150) to secure the lever to the body 110 of the charging handle 100. Respective bias elements (e.g., compression springs) bias the first lever 140 and the second lever 150 toward their relaxed positions (see, e.g., FIG. 3). The first bias element 144 is positioned within a receptacle 116 in the body 110 angled so that an end of the first biasing element 144 acts on the first lever 140; the second bias element 154 is positioned within a receptacle 118 in the body 110 angled so that an end of the second biasing element 154 acts on the second lever 150.

The first lever 140 and the second lever 150 each include an arcuate front surface (146, 156) that, in some implementations, is textured to provide a positive tactile gripping surface when the charging handle 100 is actuated by the user. The arcuate front surfaces (146, 156) allow the user to engage the first lever 140 and/or the second lever 150 with one or more fingers. Example textures that may be applied to the front surfaces (146, 156) of the levers (140, 150) include, but are not limited to, a plurality of ribs, grooves, bumps or tactile serrations. As discussed in greater detail below, when the plunger 160 is depressed, applying at least a predetermined threshold force rearward (e.g., with one or more fingers) to the first lever 140, the second lever 150, or both the first lever 140 and the second lever 150, releases the latch 130 from the latch depression in the upper receiver, allowing the charging handle 100 to be pulled rearward.

Both the first lever 140 and the second lever 150 also include a stop arm (145, 155) and a biasing arm (148, 158). Each stop arm (145, 155) is a shaft with an end (145*a*, 155*a*) configured to interface with the plunger 160 of the charging handle 100. Each biasing arm (148, 158) is an elongate shaft with a radiused tip (148*a*, 158*a*). As shown in FIG. 11A, the end portions (148*a*, 158*a*) of the biasing arms (148, 158) nest together, allowing the radiused tips of both biasing arms (148, 158) to simultaneously contact the cam surface 138 of the latch 130. In this context, "nest" refers to an overlapping arrangement of the end portions (148*a*, 158*a*) of the biasing arms (148, 158) (see, e.g., FIG. 11A).

The plunger 160 includes an actuator portion 162, a slot 164 that extends through the plunger 160, a pair of opposing cutouts (166, 168), and a guide boss 170. The actuator portion 162 is textured to provide a tactile contact surface. The plunger 160 is slidably retained within the recess 114 of the body 110 by a pin extending through both the body 110 and the slot 164 in the plunger 160. The first cutout 166 and the second cutout 168 are disposed on opposite sides of the plunger 160. Each cutout (166, 168) is configured to receive the end (145*a*, 155*a*) of the adjacent stop arm (145, 155) when the plunger is in the depressed position, and includes a radiused surface. The guide boss 170 is slidably received within a guide groove 172 located in the recess 114 of the body 110 and includes two cylindrical receptacles (174, 176). A biasing element, such as a compression spring, is positioned within each cylindrical receptacle (174, 176). The two biasing elements together generate a restoring force that urges the plunger 160 away from the guide groove 172 in the recess 114, causing the actuator portion 162 of the plunger 160 to extend outward from the recess 114 of the charging handle 100.

Operation and Use

Figure 1:
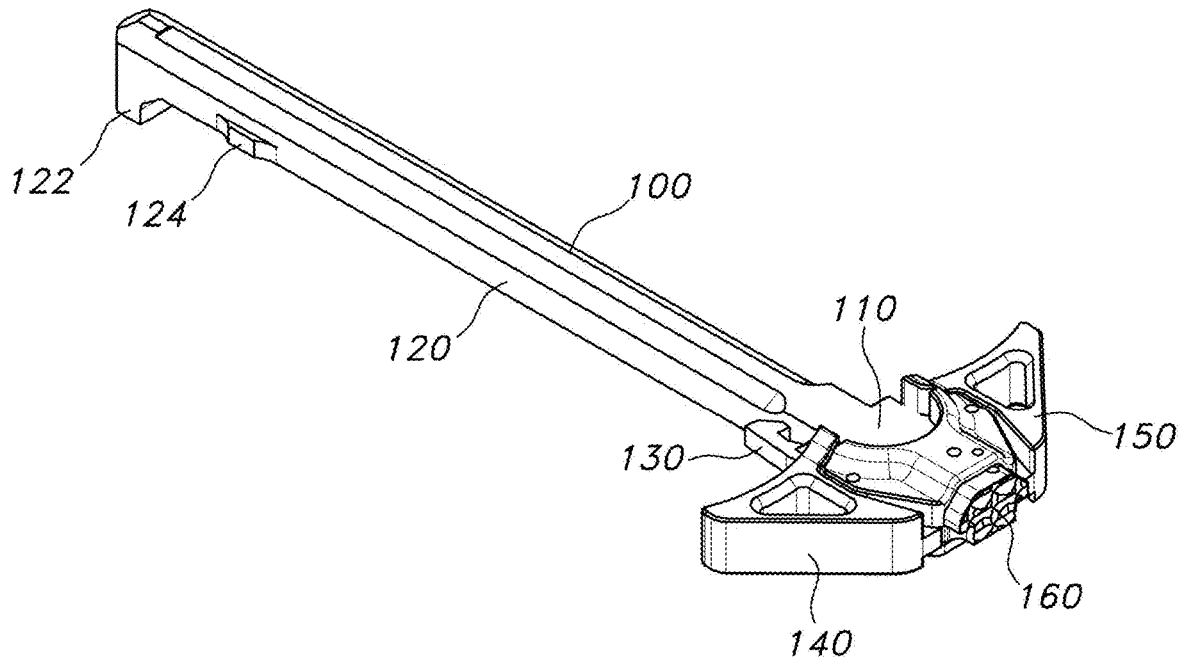
FIG. 1 is a perspective view of a charging handle according to the principles of the present disclosure.
Figure 2:
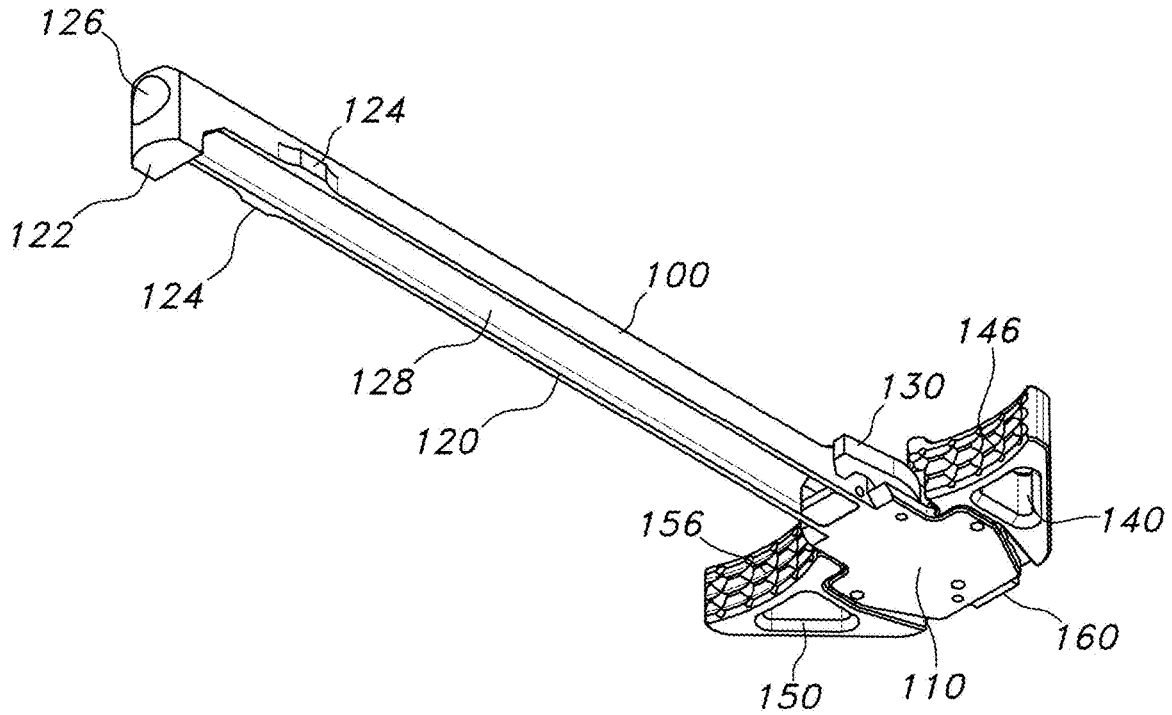
FIG. 2 is another perspective view of the charging handle shown in FIG. 1.
Figure 6:
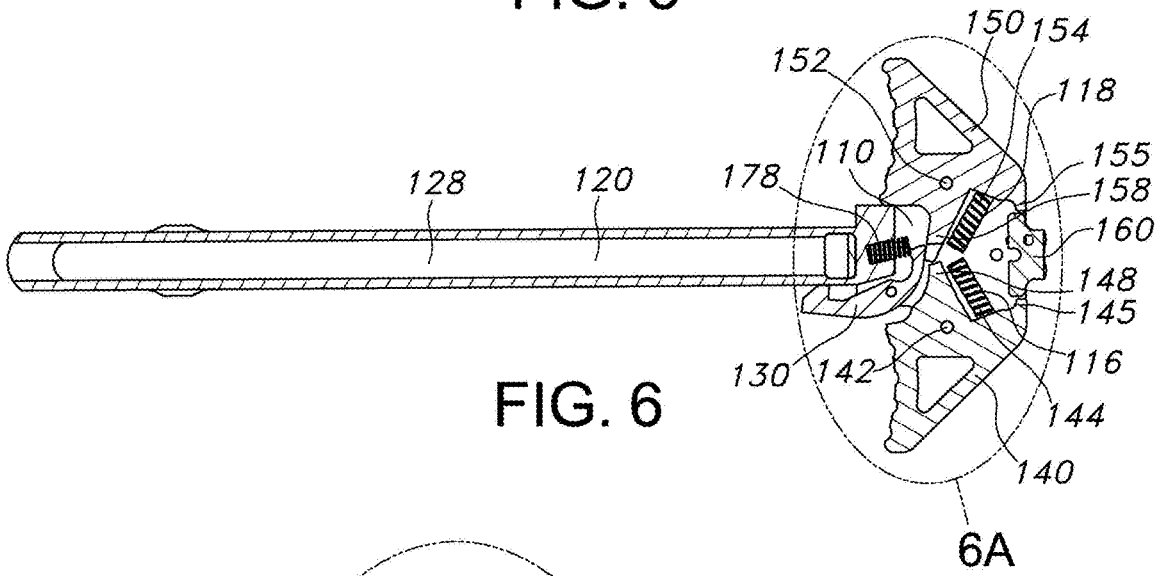
FIG. 6 is a cross-sectional view of the charging handle, taken along line 6-6 shown in FIG. 5.
Figure 6A:
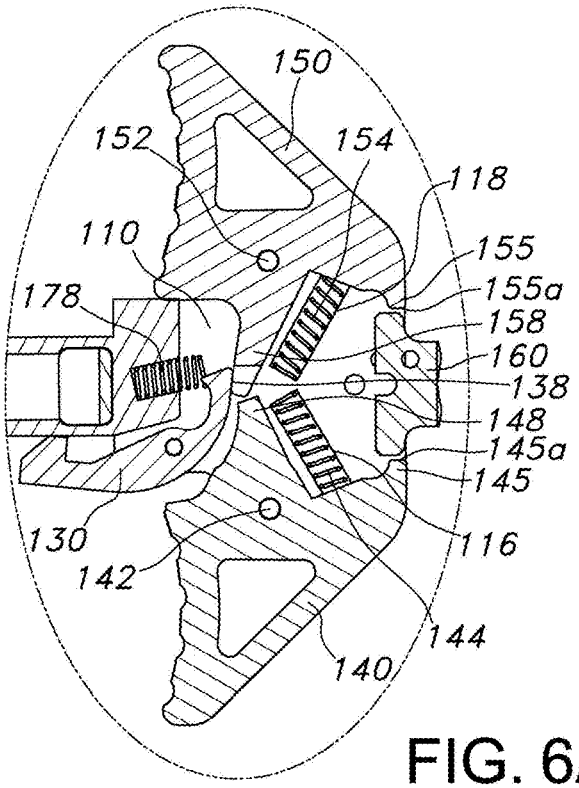
FIG. 6A is an enlarged view of a portion of the charging handle shown in FIG. 6.
Figure 7:
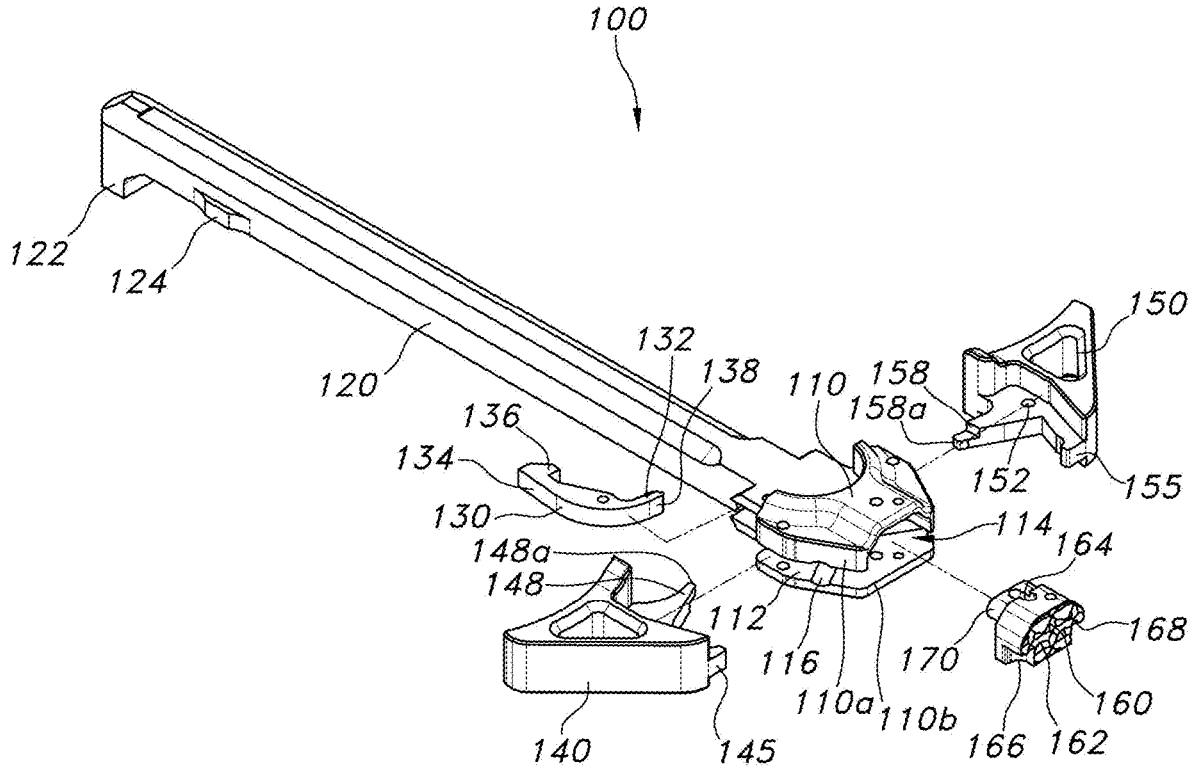
FIG. 7 is an exploded perspective view of the charging handle shown in FIG. 1.
Figure 8:
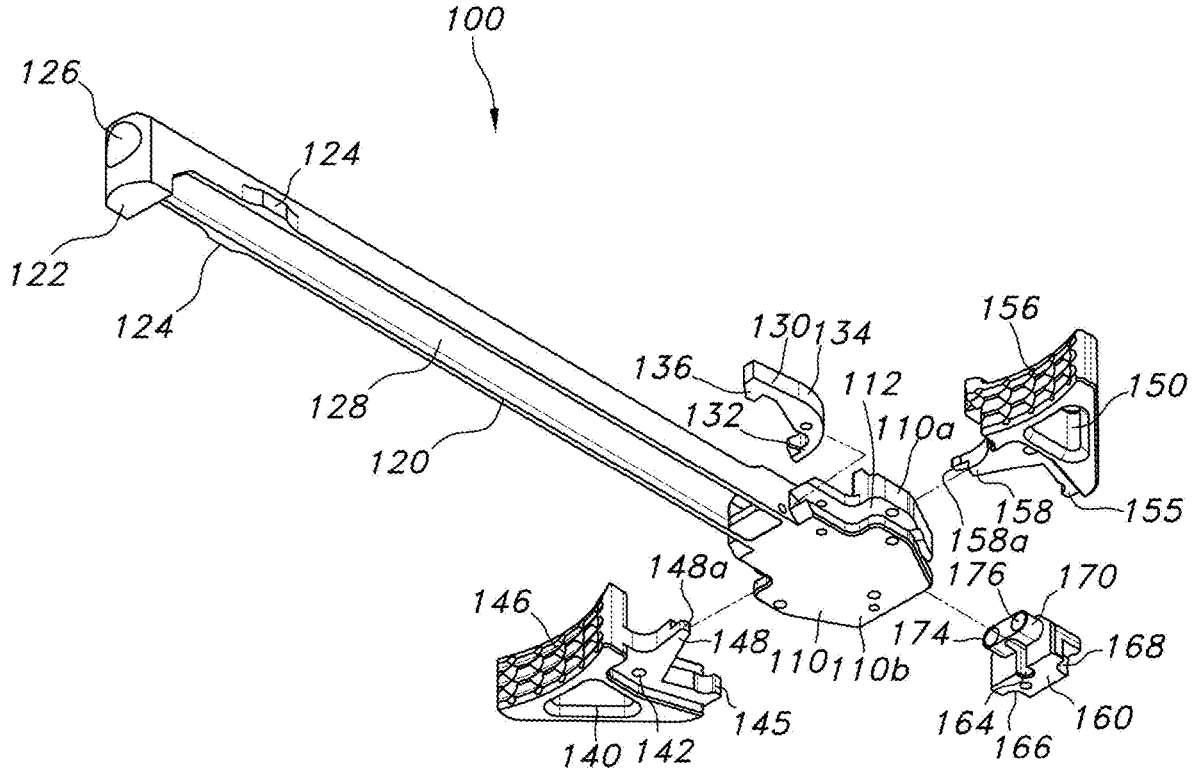
FIG. 8 is another exploded perspective view of the charging handle shown in FIG. 1.
Figure 9:
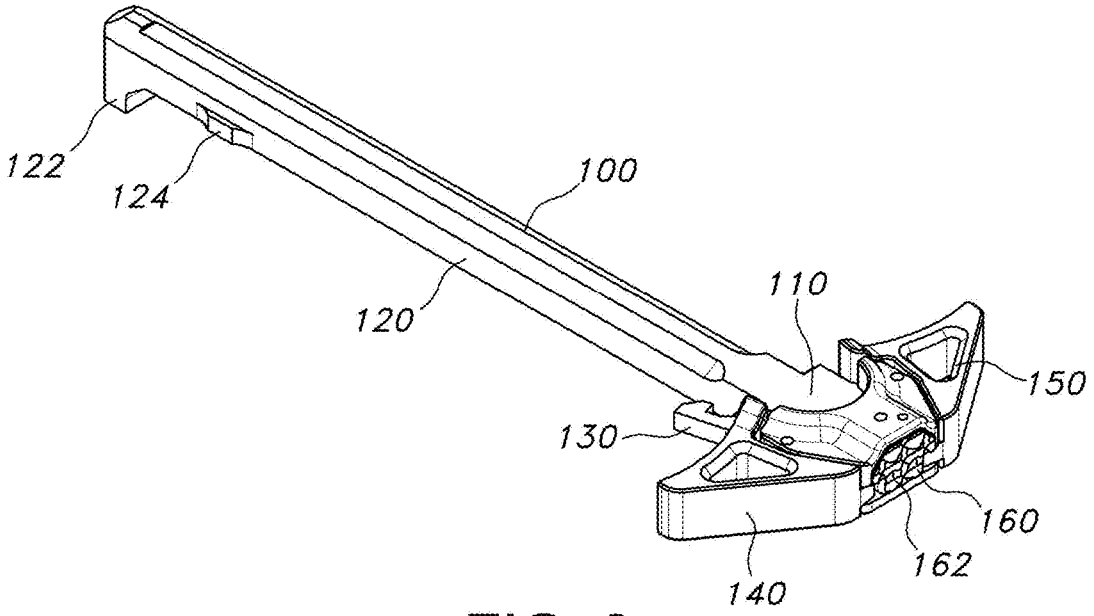
FIG. 9 is yet another perspective view of the charging handle shown in FIG. 1.

When the charging handle 100 is assembled, the biasing arm 148 of the first lever 140 and the biasing arm 158 of the second lever 150 are positioned within the receiving area 112 of the body 110. The first lever 140 and the second lever 150 are configured such that both biasing arms (148, 158) are in contact with the cam surface 138 on the latch arm 132. While the plunger 160 is in the resting position (as shown in FIG. 1), pulling either lever (140 or 150) causes its respective stop arm (145 or 155) to contact a side surface of the plunger 160, thereby preventing rotation of the pulled lever(s) (see, e.g., FIG. 6A).

Figure 10:
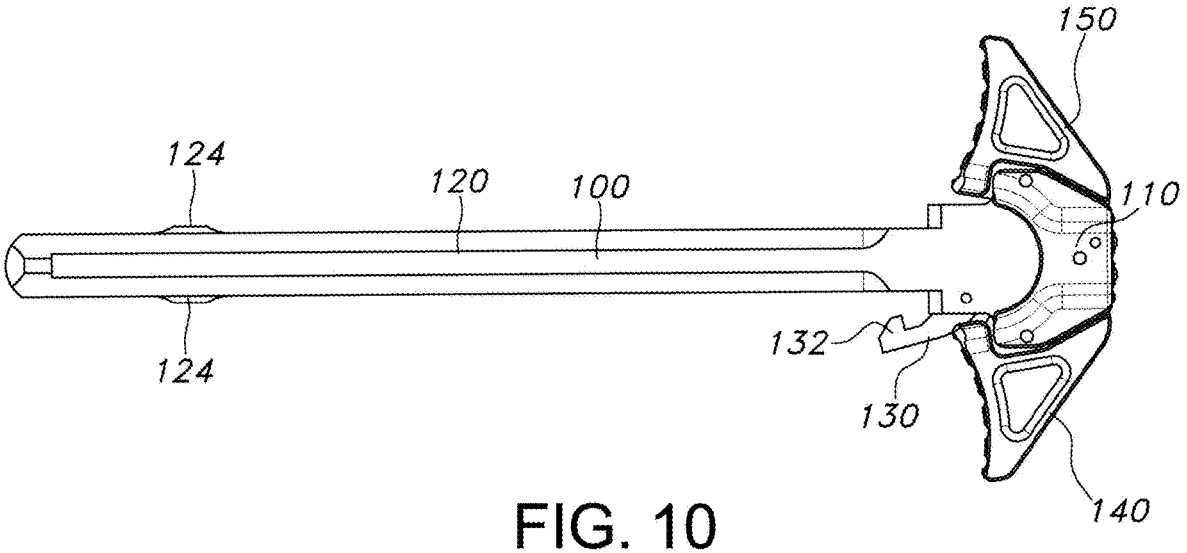
FIG. 10 is another top plan view of the charging handle shown in FIG. 1.
Figure 11:
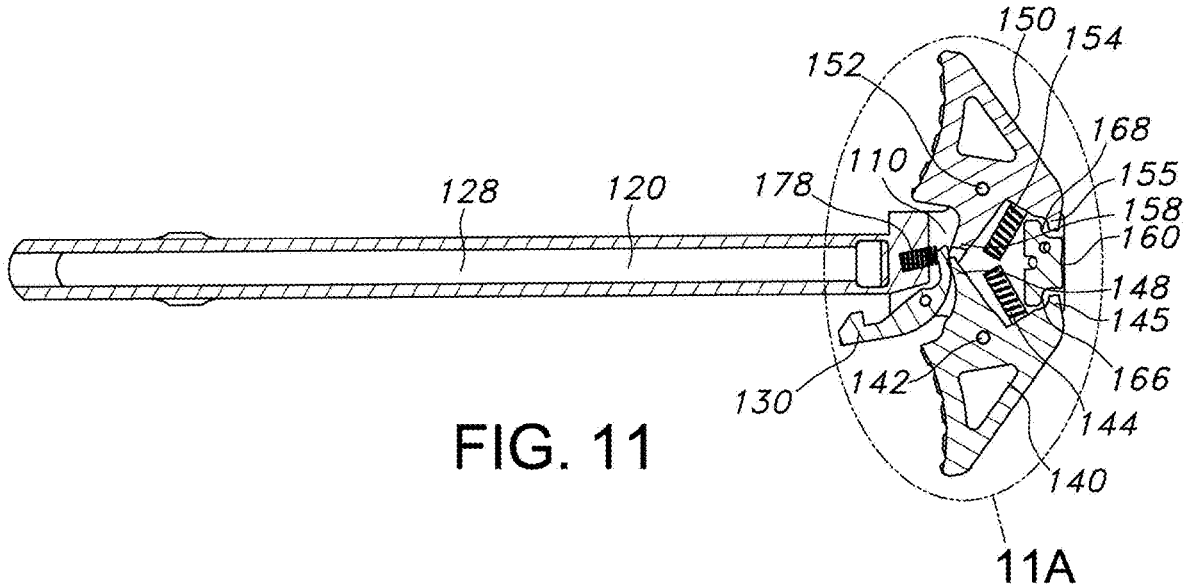
FIG. 11 is a cross-sectional view of the charging handle, taken along line 11-11 shown in FIG. 10.
Figure 11A:
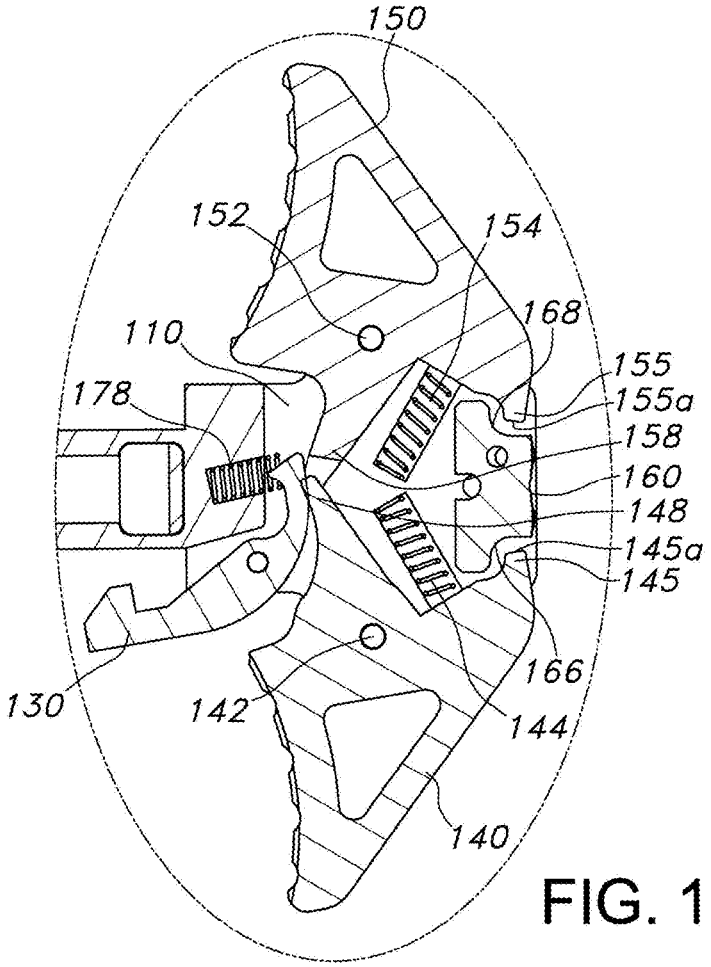
FIG. 11A is an enlarged view of a portion of the charging handle shown in FIG. 11.

When the plunger 160 is in the depressed position, applying a sufficient rearward force to the first lever 140, the second lever 150, or both causes the respective biasing arm(s) (148, 158) to press against the latch arm 132, thereby urging the latch 130 into the released position (see, e.g., FIGS. 10 and 11). At the same time, the end (145*a*, 155*a*) of the stop arm (145, 155) on the pulled lever(s) rotates into the adjacent cutout (166, 168) in the side surface of the plunger 160, allowing the lever(s) to rotate (see, e.g., FIG. 11A).

When the latch 130 is biased into the released position, the latch biasing mechanism, a compression spring 178 housed within a cavity in the body 110, is compressed. This compression generates a restoring force that urges the latch 130 to return to its relaxed position once the force applied by the user to the first lever 140 and/or the second lever 150 is sufficiently reduced.

Although not shown, in some implementations, the latch assembly of the charging handle 100 may omit the second lever 140 without departing from the scope of the present invention.

FIGS. 13-18 and 19-23 illustrate another example charging handle 200 according to the principles of the present disclosure. The charging handle 200 is similar to the charging handle 100 disclosed above. However, the charging handle 200 omits the plunger 160 and includes a clearance pocket 260 within the receiving area 212 to provide clearance for the nested end portions (248*a*, 258*a*) of the biasing arms (248, 258) of the levers (240, 250).

Figure 15:
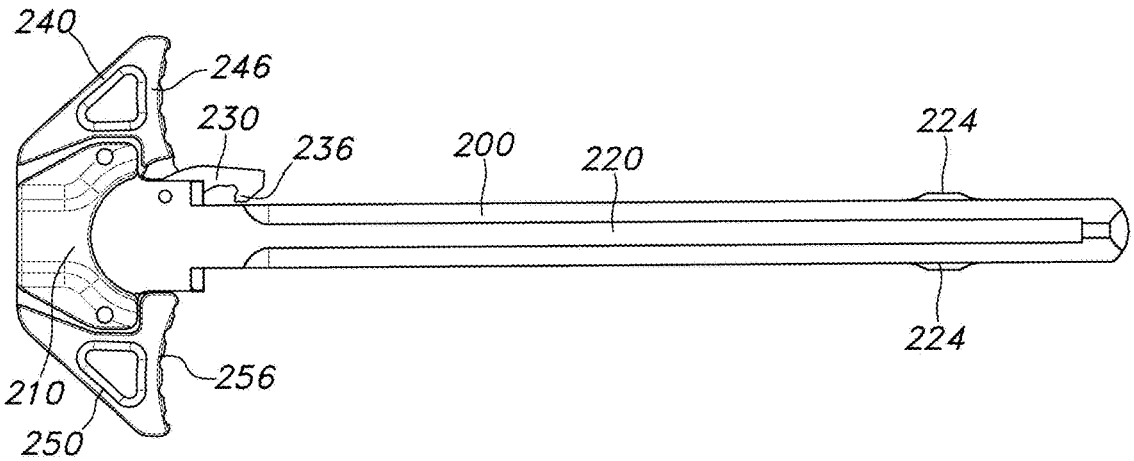
FIG. 15 is a top plan view of the charging handle shown in FIG. 13.
Figure 16:
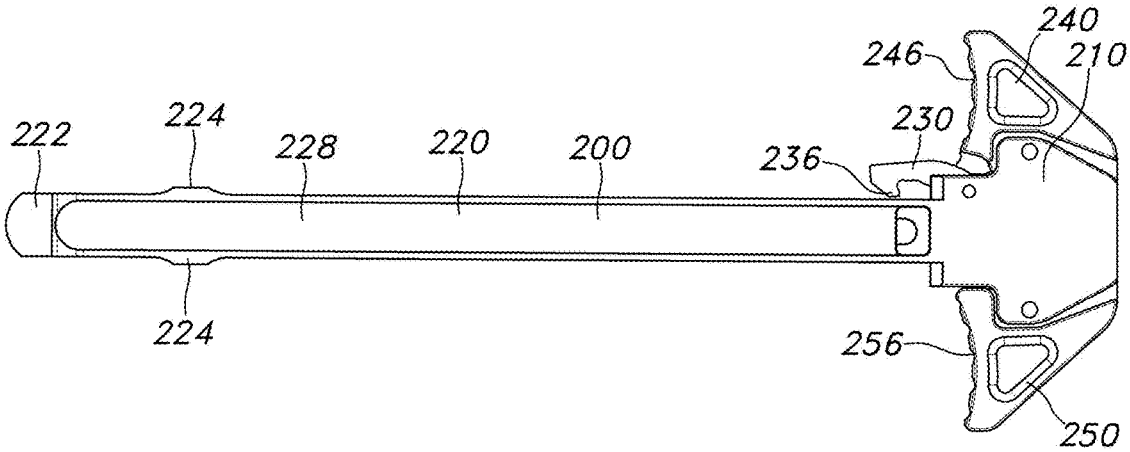
FIG. 16 is a bottom plan view of the charging handle shown in FIG. 13.
Figure 17:
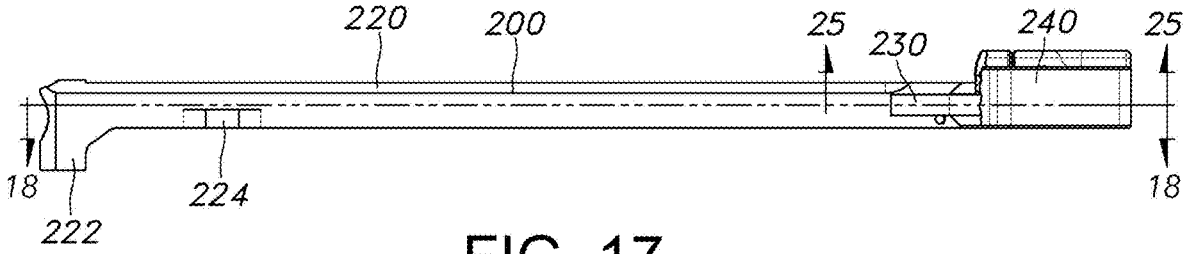
FIG. 17 is a side elevational view of the charging handle shown in FIG. 13.

The charging handle 200 comprises a body 210, a central shaft 220, and a latch assembly that includes a latch 230, a first lever 240, and a second lever 250. The body 210 is disposed behind the central shaft 220, which extends forward from the body 210. The two levers (240, 250) and the latch 230 are pivotally coupled to the body 210. The latch assembly is configured to allow either or both levers (240, 250) to be pulled, transitioning the latch 230 from a relaxed position (as shown in FIG. 15), where the latch 230 can engage the receiver of a firearm, to a released position (see, e.g., FIG. 22), which permits the normal operation of the charging handle 200.

Figure 24:
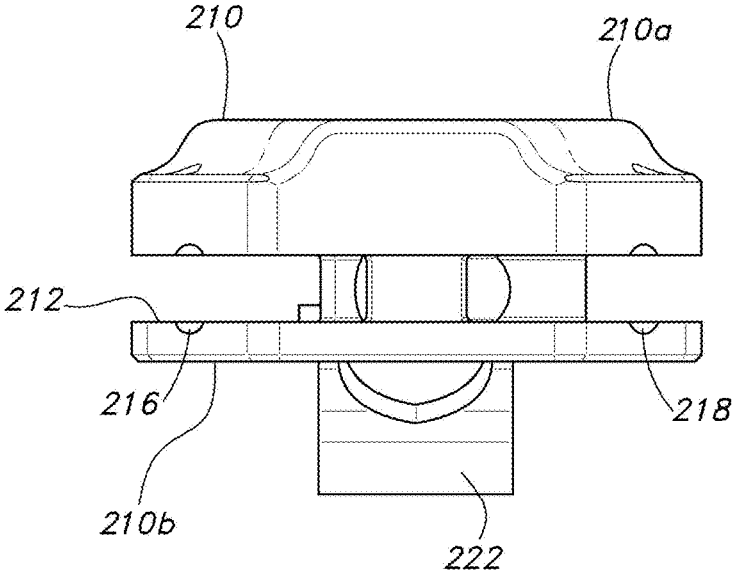
FIG. 24 is a rear elevational view of the charging handle body.
Figure 25:
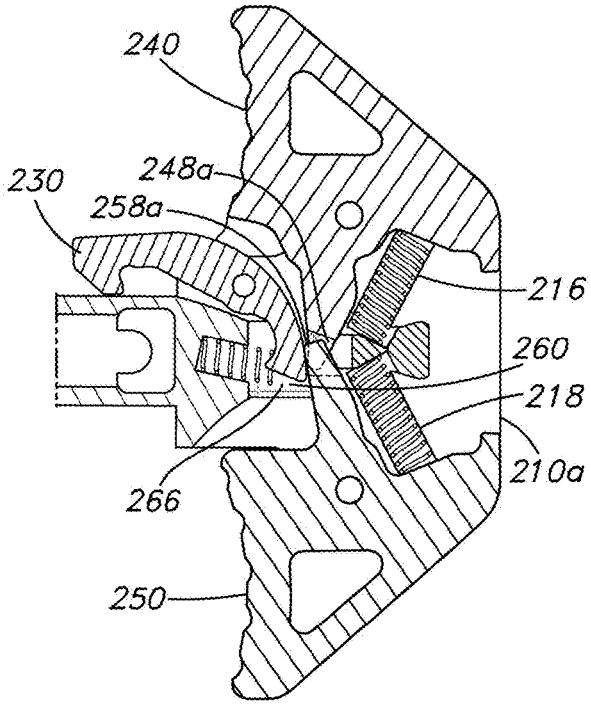
FIG. 25 is a cross-sectional view of the charging handle, taken along line 25-25 shown in FIG. 17.

The body 210 of the charging handle 200 includes a receiving area 212, and a plurality of apertures for fasteners (e.g., roll pins) used to connect the latch 230 and levers (240, 250) to the body 210. The body 210 comprises an upper portion 210*a* and a lower portion 210*b*, which is spaced apart from and located below the upper portion 210*a* (see, e.g., FIG. 24). The upper portion 210*a* and the lower portion 210*b* define therebetween the receiving area 212, the purpose of which will be described in greater detail below.

The central shaft 220 of the charging handle 200 includes a bolt carrier group engaging portion 222, a pair of alignment tabs 224, an aperture 226, and a longitudinal groove 228.

The bolt carrier group engaging portion 222 of the central shaft 220 is disposed toward a front end of the charging handle 200. The bolt carrier group engaging portion 222 engages the bolt carrier group of a firearm, such as an AR-15 type rifle, by interfacing with the charging handle engaging portion on the bolt carrier. The charging handle engaging portion is a projection on the bolt carrier; the bolt carrier being configured to carry a bolt of the bolt carrier group.

The pair of alignment tabs 224 are disposed on opposite sides of the central shaft 220 and assist in aligning the central shaft 220 in a particular direction within a slot in the upper receiver of a firearm, such as an AR-15 type rifle. Each alignment tab 224 is a projection extending from a side surface of the central shaft 220 that fits within a corresponding longitudinal recess in the upper receiver for slidable forward and backward movement of the charging handle 200 relative to the upper receiver.

The aperture 226 of the central shaft 220 is disposed within the bolt carrier group engaging portion 222 and is configured to receive the gas key of the bolt carrier therethrough. The aperture 226 provides clearance for the gas key, ensuring the charging handle 200 can properly engage with the bolt carrier.

The longitudinal groove 228 of the central shaft 220 extends from the aperture 226 to the body 210 of the charging handle 200, and is an otherwise well-known feature of charging handles configured for use with an AR-15 type firearm.

The latch 230 is pivotally coupled to the body 210 of charging handle 200 by a pin, or other suitable fastener. The latch 230 includes a latch arm 232, a hook arm 234, and a hook 236. The latch arm 232 is an elongate shaft that has a cam surface 238 on one side. The hook arm 234 includes an aperture 235 configured to receive the pin about which the latch 230 pivots. The hook 236 projects laterally from the hook arm 234 and is configured to engage a latch depression on the side of the upper receiver of an AR-15 type firearm. When the hook 236 engages the latch depression, the charging handle 200 is prevented from moving rearward and is effectively locked in position relative to the upper receiver. The latch arm 232 is disposed within the receiving area 212 of the body 210 of the charging handle 200, and is held there by the pin extending through the aperture 235 in the hook arm 234 of the latch 230.

The first lever 240 and the second lever 250 of the charging handle 200 are pivotally coupled to opposite sides of the body 210. Each lever (240, 250) has an aperture (242, 252) configured to receive a pin about which the lever (240, 250) pivots. The pin extends through apertures in the body 210 and the aperture (242, 252) in the lever (240, 250), thereby securing the lever to the body 210 of the charging handle 200. Respective bias elements (e.g., compression springs) bias the first lever 240 and the second lever 250 toward their relaxed positions (see, e.g., FIG. 15). The first bias element 244 is positioned within a receptacle 216 in the body 210 angled so that an end of the first element 244 acts on the first lever 240; the second bias element 254 is positioned within a receptacle 218 in the body 210 angled so that an end of the second bias element 254 acts on the second lever 250.

The first lever 240 and the second lever 250 each include an arcuate front surface (246, 256) that, in some implementations, is textured to provide a positive tactile gripping surface when the charging handle 200 is actuated by the user. The arcuate front surfaces (246, 256) allow the user to engage the first lever 240 and/or the second lever 250 with one or more fingers. Example textures that may be applied to the front surfaces (246, 256) of the levers (240, 250) include, but are not limited to, a plurality of ribs, grooves, bumps or tactile serrations. Applying at least a predetermined threshold force rearward (e.g., with one or more fingers) to the first lever 240, the second lever 250, or both the first lever 240 and the second lever 250, releases the latch 230 from the latch depression in the upper receiver, thereby allowing the charging handle 200 to be pulled rearward.

Both the first lever 240 and the second lever 250 also include a biasing arm (248, 258). Each biasing arm (248, 258) is an elongate shaft with a radiused tip. As shown in FIG. 22A, the end portions (248*a*, 258*a*) of the biasing arms (248, 258) nest together, allowing the radiused tips of both biasing arms (248, 258) to simultaneously contact the cam surface 238 of the latch 230. In this context, "nest" refers to an overlapping arrangement of the end portions (248*a*, 258*a*) of the biasing arms (248, 258) (see, e.g., FIG. 23A).

Figure 18:
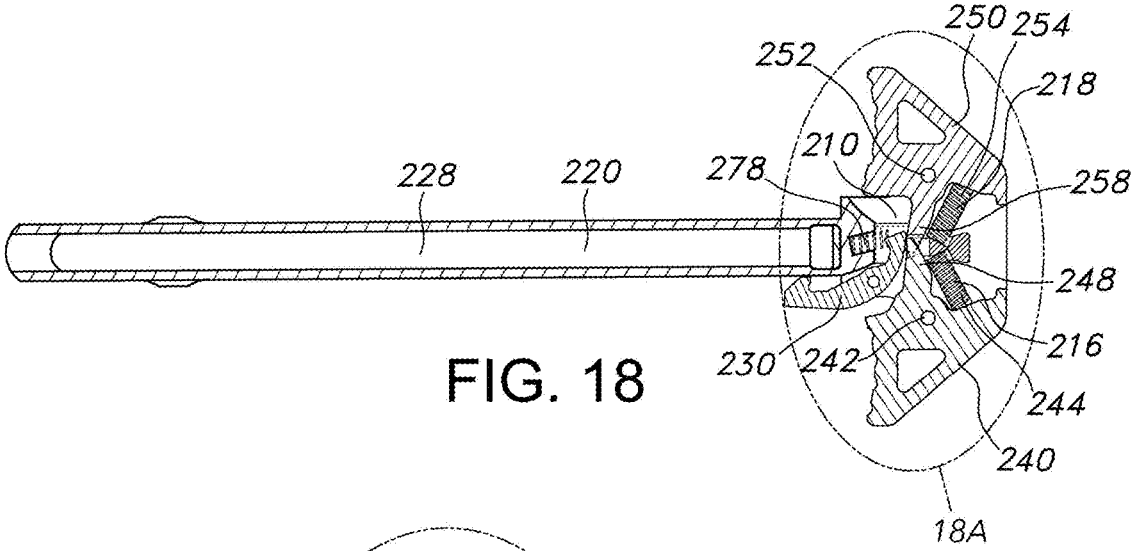
FIG. 18 is a cross-sectional view of the charging handle, taken along line 18-18 shown in FIG. 17.
Figure 18A:
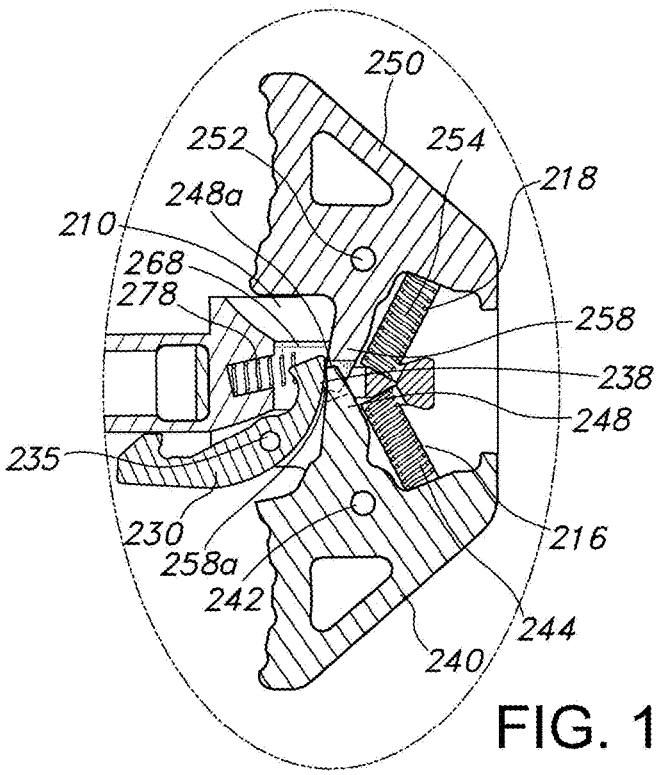
FIG. 18A is an enlarged view of a portion of the charging handle shown in FIG. 18.
Figure 19:
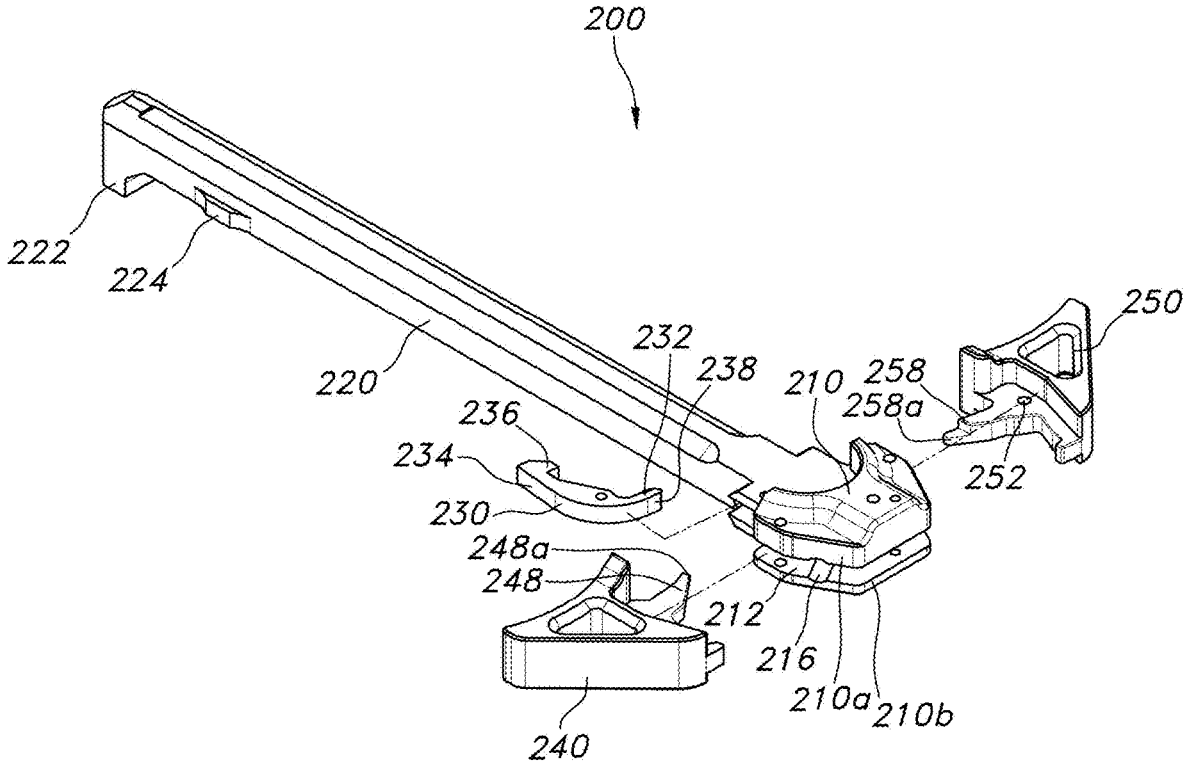
FIG. 19 is an exploded perspective view of the charging handle shown in FIG. 13.
Figure 20:
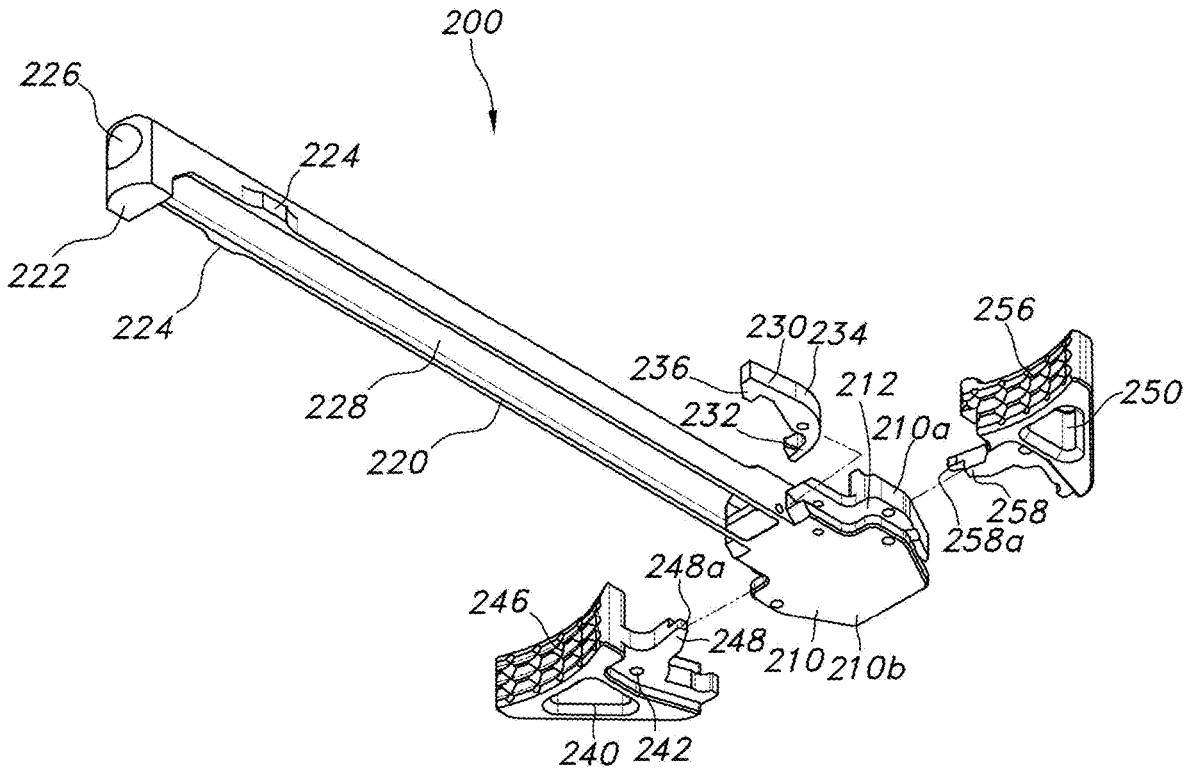
FIG. 20 is another exploded perspective view of the charging handle shown in FIG. 13.
Figure 21:
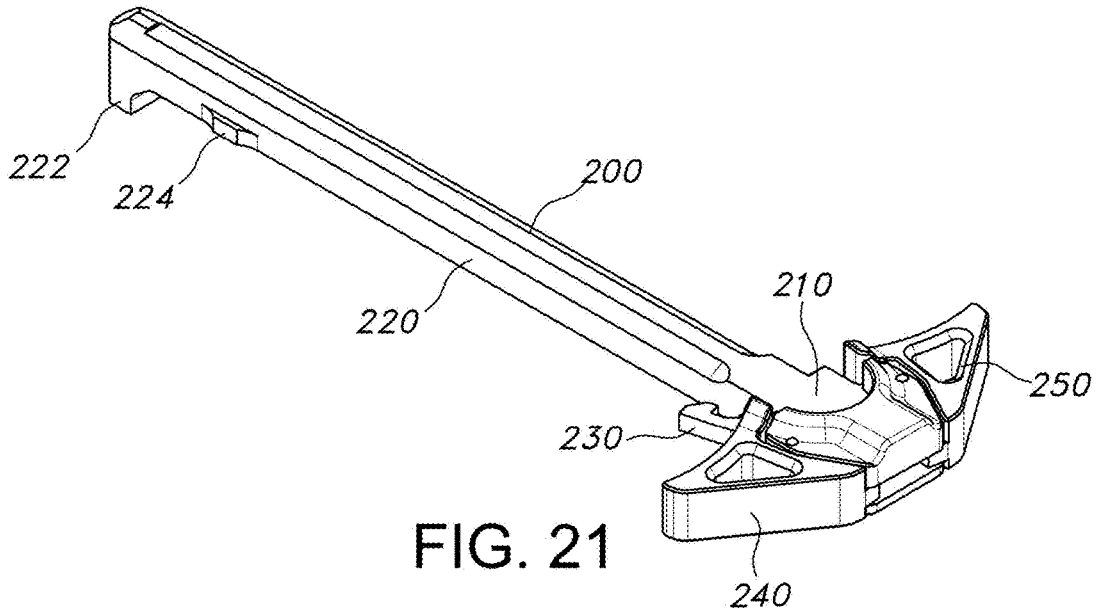
FIG. 21 is yet another perspective view of the charging handle shown in FIG. 13.
Figure 22:
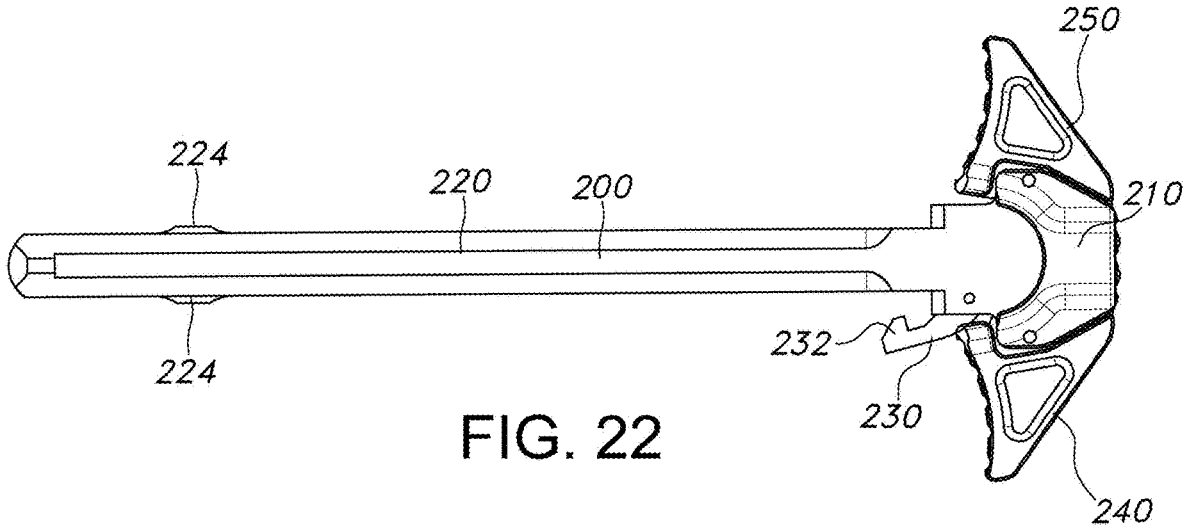
FIG. 22 is another top plan view of the charging handle shown in FIG. 13.
Figure 26:
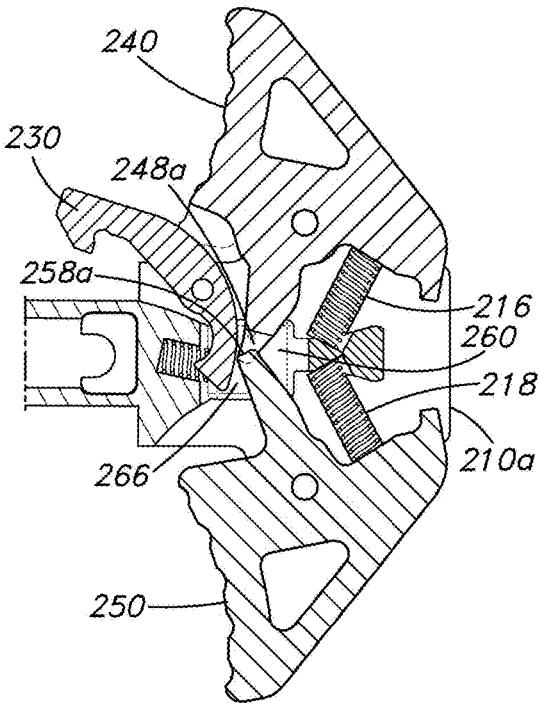
FIG. 26 is an additional cross-sectional view of the charging handle shown in FIG. 25, wherein the latch has been pivoted to the released position by both levers.

As shown in FIGS. 18A and 26, the clearance pocket 260 within the receiving area 212 of the body 210 comprises two recesses (266, 268) positioned opposite each other. One recess 266 is located in the upper portion 210*a*, and the other recess 268 is located in the lower portion 210*b* of the body 210. The end portions (248*a*, 258*a*) of the biasing arms (248, 258) are positioned within the clearance pocket 260, between the two recesses (266, 268), which are configured to accommodate the travel paths of the end portions (248*a*, 258*a*) during operation of the associated levers (240, 250). In particular, the recesses (266, 268) provide clearance for the end portions (248*a*, 258*a*) as they pivot, preventing the biasing arms (248, 258) from catching. Both recesses (266, 268) are substantially rectangular, but may alternatively have other suitable shapes configured to encompass the travel paths of the end portions (248*a*, 258*a*).

While it is possible for the levers (240, 250) to function without the clearance pocket 260, incorporating the clearance pocket 260 into the receiving area 212 of the body 210 enhances reliability by ensuring sufficient clearance for the end portions (248*a*, 258*a*) of the levers (240, 250) as they pivot. Additionally, although the clearance pocket 260 is not strictly required, it simplifies manufacturing by accommodating wider machining tolerances and reducing the need for highly precise alignment.

Operation and Use

When the charging handle 200 is assembled, the biasing arm 248 of the first lever 240 and the biasing arm 258 of the second lever 250 are positioned within the receiving area 212 of the body 210. The first lever 240 and the second lever 250 are configured such that both biasing arms (248, 258) are in contact with the cam surface 238 on the latch arm 232.

Figure 23:
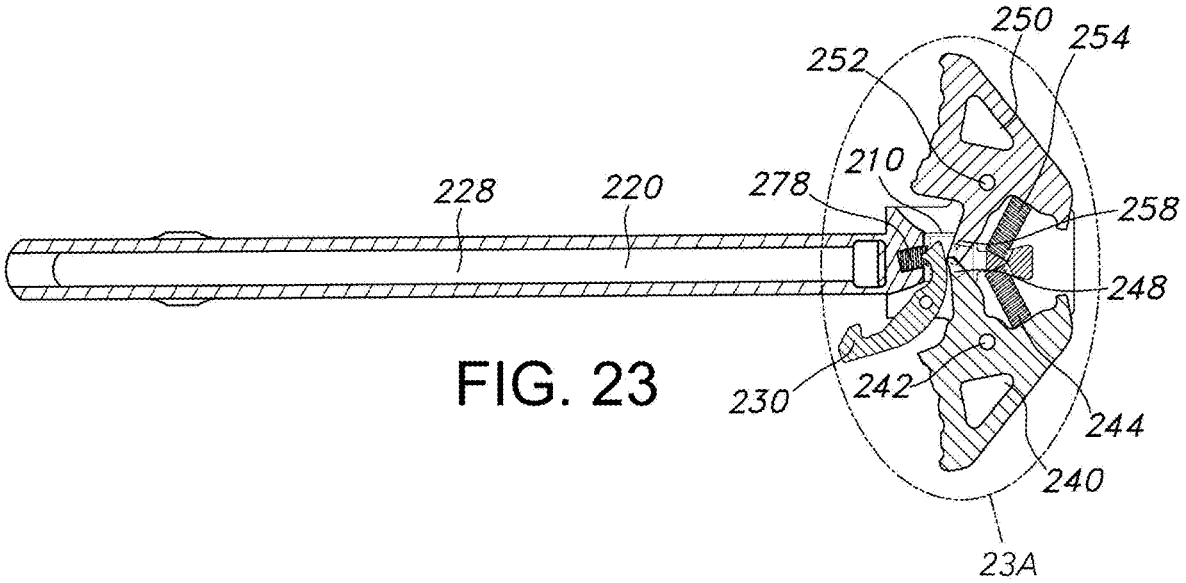
FIG. 23 is a cross-sectional view of the charging handle, taken along line 23-23 shown in FIG. 22.
Figure 23A:
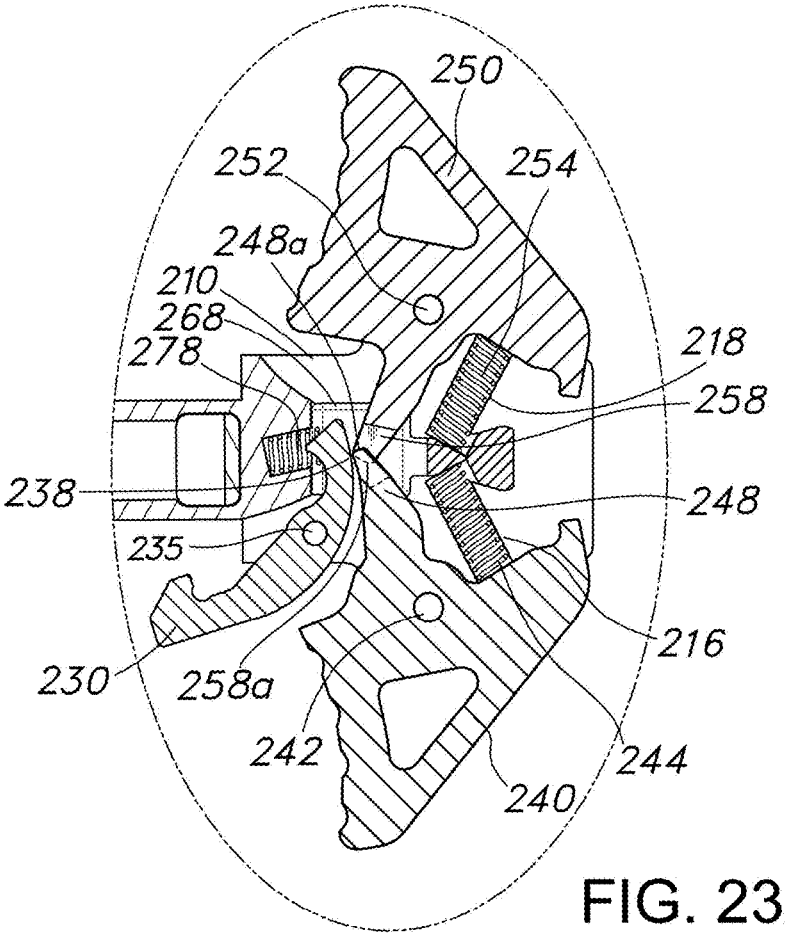
FIG. 23A is an enlarged view of a portion of the charging handle shown in FIG. 23.

Applying a sufficient rearward force to the first lever 240, the second lever 250, or both causes the respective biasing arm (248, 258) to press against the cam surface 238 of the latch arm 232, thereby urging the latch 230 into the released position (see, e.g., FIG. 23).

When the latch 230 is biased into the released position, the latch biasing mechanism, a compression spring 278 housed within a cavity in the body 210, is compressed. This compression generates a restoring force that urges the latch 230 to return to its relaxed position once the force applied by the user to the first lever 240 and/or the second lever 250 is sufficiently reduced.

The foregoing description of the invention is intended to be illustrative; it is not intended to be exhaustive or to limit the claims to the precise forms disclosed. Those skilled in the relevant art can appreciate that many modifications and variations are possible in light of the foregoing description and associated drawings.

Reference throughout this specification to an "embodiment" or "implementation" or words of similar import means that a particular described feature, structure, or characteristic is included in at least one embodiment of the present invention. Thus, the phrase "in some implementations" or a phrase of similar import in various places throughout this specification does not necessarily refer to the same embodiment.

The described features, structures, or characteristics may be combined in any suitable manner in one or more embodiments. In the above description, numerous specific details are provided for a thorough understanding of embodiments of the invention. One skilled in the relevant art will recognize, however, that embodiments of the invention can be practiced without one or more of the specific details, or with other methods, components, materials, etc. In other instances, well-known structures, materials, or operations may not be shown or described in detail.

The invention claimed is:

1. A charging handle for a firearm, the charging handle comprising:

a body, the body including a receiving area;

a central shaft extending forwardly from the body, the central shaft being configured to engage a bolt carrier group of the firearm;

a first lever pivotally coupled to the body, the first lever comprising a first biasing arm having an end portion with a radiused tip;

a second lever pivotally coupled to the body, the second lever comprising a second biasing arm having an end portion with a radiused tip; and a latch pivotally coupled to the body, the latch having a relaxed position and a released position, and comprising a latch arm and a hook arm, with at least a portion of the latch arm disposed within the receiving area of the body;

wherein:

pivoting the first lever moves the latch between the relaxed position and the released position;

pivoting the second lever moves the latch between the relaxed position and the released position; and the end portion of the first biasing arm and the end portion of the second biasing arm nest together, such that both radiused tips contact a camming surface on the latch arm of the latch.

2. The charging handle of claim 1, wherein the first lever and the second lever pivot independently of one another about discrete pivot points.

3. A charging handle for a firearm, the charging handle comprising:

a body, the body including a receiving area and a clearance pocket located within the receiving area;

a central shaft extending forwardly from the body, the central shaft being configured to engage a bolt carrier group of the firearm;

a first lever pivotally coupled to the body, the first lever comprising a first biasing arm having an end portion with a radiused tip;

a second lever pivotally coupled to the body, the second lever comprising a second biasing arm having an end portion with a radiused tip; and a latch pivotally coupled to the body, the latch having a relaxed position and a released position, and comprising a latch arm and a hook arm, with at least a portion of the latch arm disposed within the receiving area of the body;

wherein:

pivoting the first lever moves the latch between the relaxed position and the released position;

pivoting the second lever moves the latch between the relaxed position and the released position; and the end portion of the first biasing arm and the end portion of the second biasing arm nest together within the clearance pocket, such that both radiused tips contact a camming surface on the latch arm.

4. The charging handle of claim 3, wherein the first lever and the second lever pivot independently of one another about discrete pivot points.

5. The charging handle of claim 3, wherein:

the receiving area of the body is defined between an upper portion and a lower portion of the body; and the clearance pocket comprises two recesses positioned opposite each other within the receiving area, wherein a first recess is located in the upper portion of the body, and a second recess is located in the lower portion of the body.

* * * * *